US006223471B1

(12) United States Patent
Barber

(10) Patent No.: US 6,223,471 B1
(45) Date of Patent: May 1, 2001

(54) SLIDING DOOR WITH WHEEL REPAIR KIT

(76) Inventor: Jerry Keith Barber, P.O. Box 1323, Willis, TX (US) 77378

( * ) Notice: Subject to any disclaimer, the term of this patent is extended or adjusted under 35 U.S.C. 154(b) by 0 days.

(21) Appl. No.: 09/224,143

(22) Filed: Dec. 31, 1998

(51) Int. Cl.[7] ..... E05D 13/00
(52) U.S. Cl. ..... 49/425
(58) Field of Search ..... 49/425, 426, 427, 49/404

(56) References Cited

U.S. PATENT DOCUMENTS

| | | | | |
|---|---|---|---|---|
| 296,629 | | 4/1884 | Saunders et al. . | |
| 1,008,987 | | 11/1911 | Prouty . | |
| 1,713,088 | | 5/1929 | Nicholson . | |
| 2,878,091 | | 3/1959 | Hammond | 312/209 |
| 3,241,283 | | 3/1966 | Ahlgren | 52/494 |
| 3,509,665 | | 5/1970 | Bartlett et al. | 49/410 |
| 3,670,357 | * | 6/1972 | Steigerwald | 49/425 X |
| 3,760,536 | | 9/1973 | Wolak | 49/426 |
| 4,282,631 | * | 8/1981 | Uehara et al. | 49/425 X |
| 4,353,186 | | 10/1982 | Offterdinger | 49/420 |
| 4,590,707 | * | 5/1986 | von Resch | 49/425 X |
| 4,639,970 | * | 2/1987 | Adams | 49/425 X |
| 4,722,150 | | 2/1988 | Jacobs et al. | 49/425 |
| 4,873,741 | | 10/1989 | Riegelman | 16/105 |
| 4,899,493 | | 2/1990 | Baumgarten | 49/425 |
| 5,671,502 | | 9/1997 | Ezman | 16/105 |

FOREIGN PATENT DOCUMENTS

| | | | | |
|---|---|---|---|---|
| 203243 | * | 9/1923 | (GB) | 49/425 |

* cited by examiner

*Primary Examiner*—Jerry Redman
(74) *Attorney, Agent, or Firm*—Bracewell & Patterson, L.L.P.

(57) ABSTRACT

A repair kit for a sliding glass patio door having worn original wheel assemblies includes an edge bracket with an associated edge wheel for installation on a leading edge of the door and a side bracket with an associated side wheel for installation on a side of the door near a trailing edge. The edge wheel and the side wheel support the weight of the door, while the worn original wheel assemblies are left in place for guiding the door. An original track for the door provides a guideway on which the door and the original wheel assemblies travel. The edge bracket includes an edge plate that can be fastened to the leading edge, and a frame is attached to the edge plate. An axle is mounted in the frame, and the edge wheel is mounted on the axle. The side bracket has a side plate and a frame. The frame has legs mounted parallel to the side plate for holding an axle perpendicular to the side plate. The side wheel is mounted on the axle located within the frame on the side plate.

9 Claims, 2 Drawing Sheets

FIG. 5
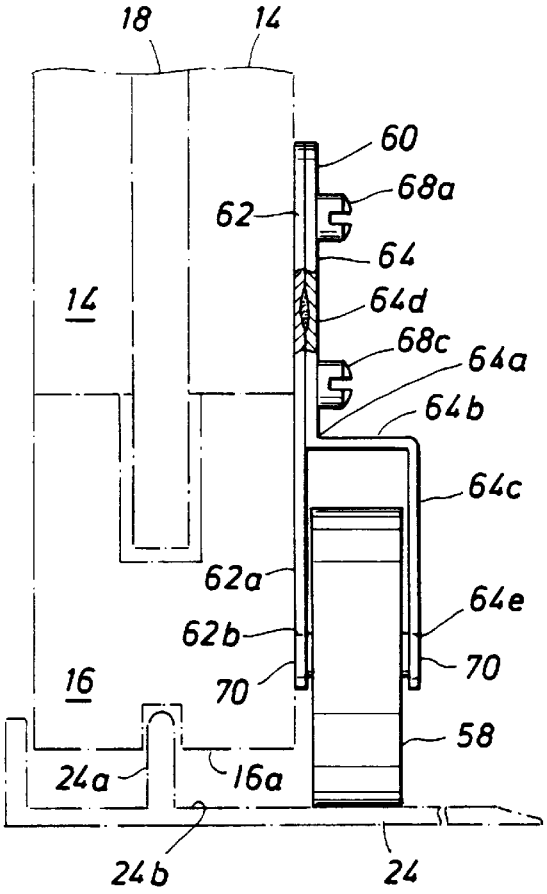
FIG. 6
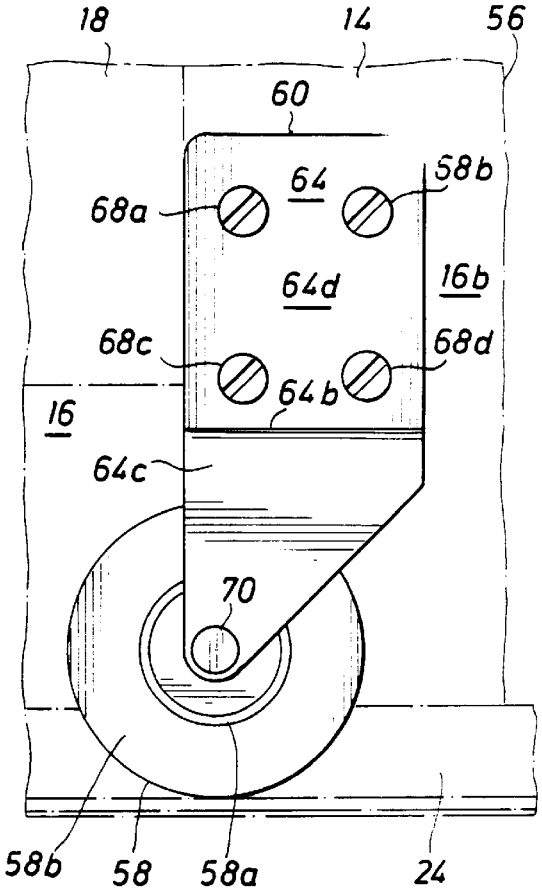
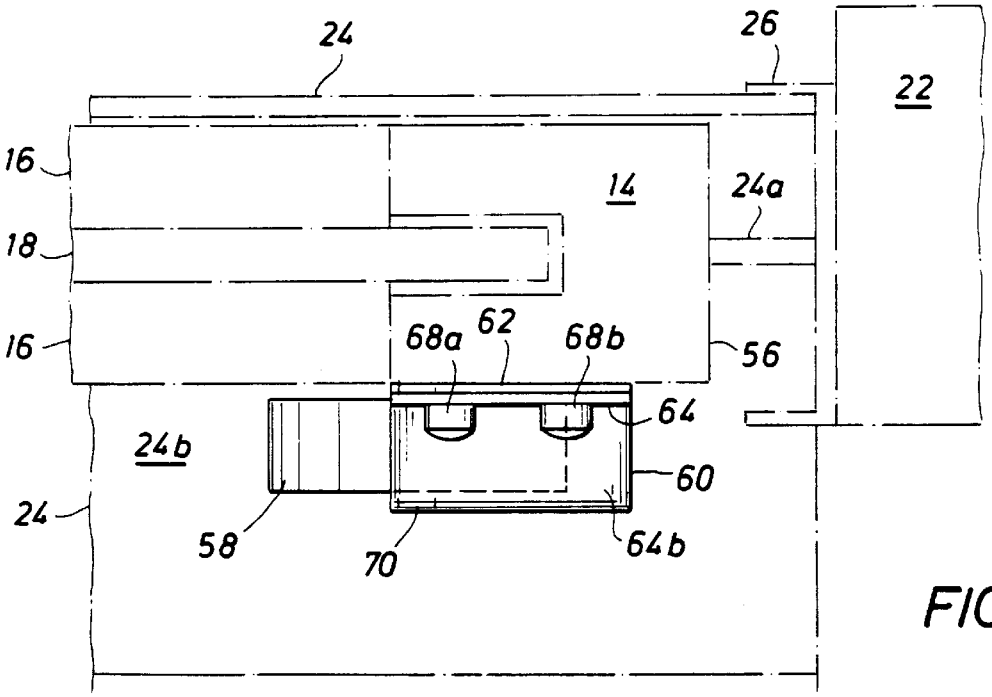
FIG. 7

SLIDING DOOR WITH WHEEL REPAIR KIT

BACKGROUND OF THE INVENTION

1. Field of the Invention

The present invention pertains to sliding doors, and more particularly to a repair kit for a rolling door having worn original wheels, a rolling door with external wheels and a method for repairing a sliding glass door.

2. Description of the Related Art

Homes often have sliding glass doors, which are doors that roll on a set of wheels that are engaged with a track. Over time, these wheels become worn and in need of replacement. The replacement of the original wheel assemblies is quite expensive and time consuming. Consequently, the sliding glass door is often replaced entirely for want of repair or replacement of the original wheel assemblies.

SUMMARY OF THE INVENTION

An inexpensive and easily installed repair kit is provided for repairing a sliding or rolling door having original wheel assemblies that are worn and in need of replacement. The door has a leading edge, a trailing edge, and a bottom panel that has a bottom edge and a side. Through an opening in the bottom edge of the bottom panel, the original wheel assemblies roll on a guideway that is located on a track.

Rather than replacing the worn original wheel assemblies, a repair kit provides new wheels for supporting the door. The repair kit includes an edge bracket adapted for attachment to the leading edge near the bottom edge. The edge bracket has a frame, and an edge wheel, mounted on an axle, is located in the frame. The repair kit further includes a side bracket adapted for attachment to the side of the bottom panel near the trailing edge. The side bracket has a frame, and a side wheel is rotatably mounted on an axle, which is then received in the frame. The repair kit thus provides an edge wheel and a side wheel that can be mounted on external surfaces of the door, while leaving the original wheel assemblies intact inside the bottom panel.

In another aspect, a sliding glass door is provided that has a door panel, which has a leading edge, a trailing edge, and a bottom panel. The bottom panel has a bottom edge and a side. An edge bracket, which has a frame and an axle mounted in the frame, is attached to the leading edge next to the bottom edge. An edge wheel having very little friction is mounted on the axle in the edge bracket A side bracket is attached to the side of the bottom panel next to the trailing edge. The side bracket has a frame adapted for receiving an axle, and a side wheel is mounted on the axle in the side bracket.

Preferably, the door includes a track located below the bottom panel, and the edge wheel and the side wheel roll on the track as the door is rolled from an open to a closed position or vice versa Typically, but not necessarily, the door has original wheel assemblies, and the track has a guideway. The original wheel assemblies engage the guideway for supporting and guiding the door. With the addition of the edge and side wheels, the original wheel assemblies may guide the door while the edge and side wheels support the weight of the door.

In yet another aspect, a method is provided for repairing a sliding glass door that has worn original wheel assemblies in need of replacement The method involves installing brackets on outside surfaces of the door. One bracket is installed on an edge of the door, and another bracket is installed on a side of the door. A wheel is received in each bracket for supporting the weight of the door and providing a mechanism for rolling the door from one position to another within a track.

BRIEF DESCRIPTION OF THE DRAWINGS

FIG. 5 is a side elevation of a side wheel assembly, according to the present invention.

FIG. 6 is a front elevation of the side wheel assembly of FIG. 5.

FIG. 7 is a top view of the side wheel assembly of FIG. 6.

DETAILED DESCRIPTION OF INVENTION

Figure 1:
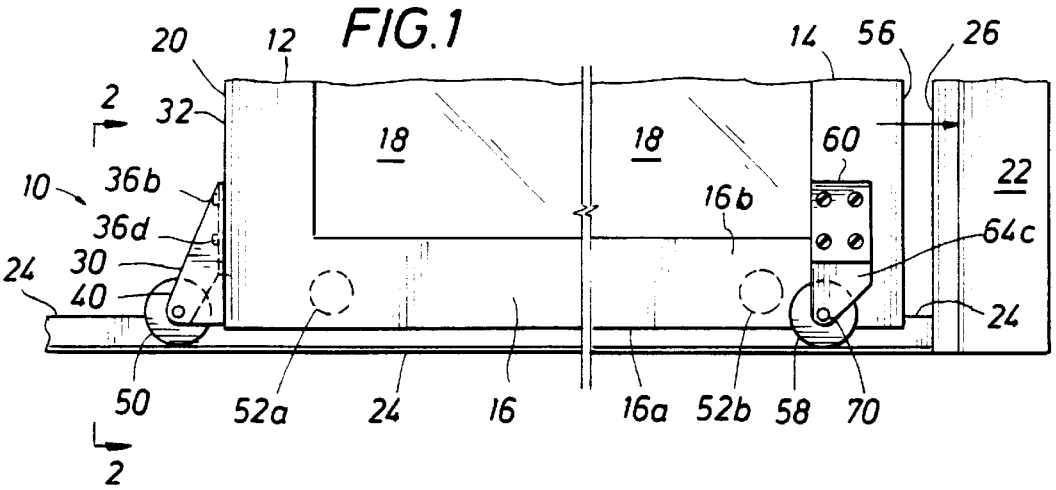
FIG. 1 is a side view of a sliding glass door, according to the present invention.

With reference to FIG. 1, a sliding glass door 10 includes a left panel 12, a right panel 14 and a bottom panel 16, which has a bottom edge 16*a* and a side 16*b*. A sheet of glass 18 is secured by panels 12, 14, and 16. Panels 12, 14 and 16 and glass 18 comprise a typical sliding glass patio door 20. Patio door 20 is received in a door frame 22 and rides on a track 24. A channel 26 is attached to door frame 22 for receiving patio door 20, particularly right panel 14, in sealing engagement.

Figure 3:
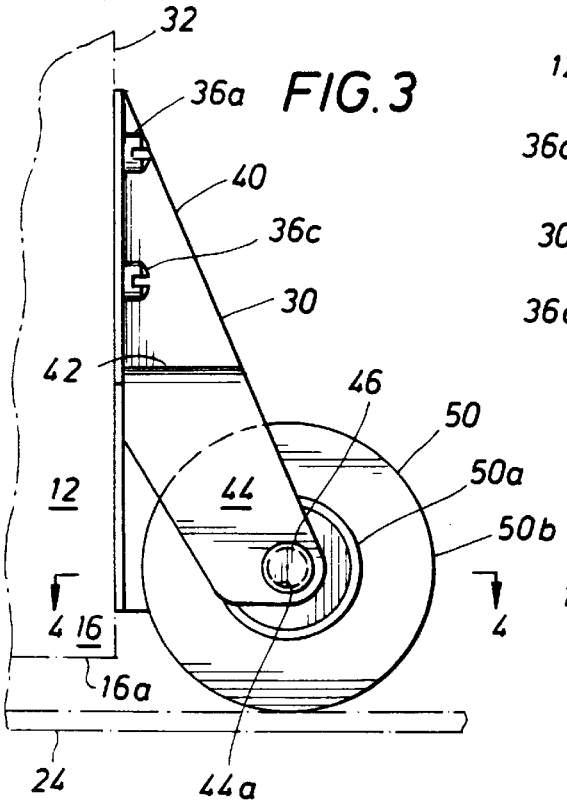
FIG. 3 is a side view of the edge bracket of FIG. 2.
Figure 2:
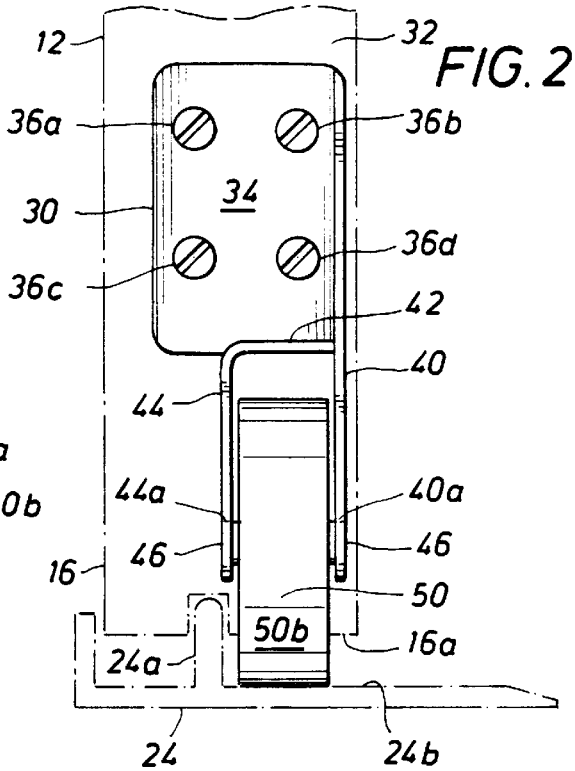
FIG. 2 is an elevation of an edge wheel assembly, according to the present invention, as seen along the lines 2—2 in FIG. 1.

With reference to FIGS. 1–3, an edge bracket 30 is fastened to an edge 32 of left panel 12. Edge 32 is referred to generally for descriptive purposes as a leading edge. Edge bracket 30 includes an edge plate 34 that is attached to leading edge 32 by fasteners or screws 36*a*, 36*b*, 36*c*, and 36*d*.

A plate 40 extends perpendicularly from edge plate 34 and is typically made by bending a flat sheet of metal at a right angle so as to form edge plate 34 and plate 40. A plate 42 is secured, such as by welding, to edge plate 34 and plate 40. A plate 44 extends perpendicularly from edge plate 34 and parallel to plate 40. Plates 42 and 44 are typically made by bending a single sheet of metal, which is then welded to edge plate 34 and plate 40. Edge plate 34 and plates 40, 42, and 44 form a frame, which includes a U-shape formed by plates 40, 42 and 44. Plate 40 has an axle hole 40*a*, and plate 44 has an axle hole 44*a* An axle 46 is mounted, such as by welding, in holes 40*a* and 44*a*.

Figure 4:
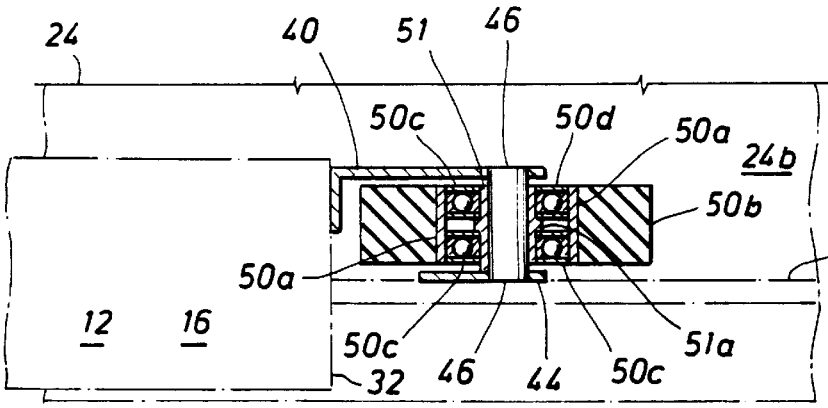
FIG. 4 is a sectional view of the edge wheel assembly of FIG. 3, as seen along the lines 4—4 in FIG. 3.

A wheel 50, referred to generally as edge wheel 50, is rotatably mounted on axle 46. Wheel 50 includes a hub 50*a* and a tire 50*b*. Hub 50*a* includes dual, parallel sets of ball bearings 50*c* and 50*d*, as shown in FIG. 4. Tire 50*b* is preferably made of a synthetic plastic or resin material. Wheel 50 is preferably a wheel commercially available from suppliers of wheels for in-line roller skates that are referred to as roller blades. Thus, wheel 50 can be obtained from suppliers to in-line skate manufacturers, but with tires that are squared off rather than rounded.

Door 10 typically has original wheel assemblies 52*a* and 52*b* located in bottom panel 16, which are illustrated as a pair of wheels shown in hidden lines in FIG. 1. Original wheel assemblies 52*a* and 52*b* are conventional for a sliding glass patio door. As best seen in FIG. 3, track 24 has a guideway 24*a*, and original wheel assemblies 52*a* and 52*b* roll on guideway 24*a* As shown here, guideway 24*a* is a rail, and original wheel assemblies 52*a* and 52*b* have wheels with a V-shaped groove for engaging guideway 24*a*. An alternative guideway can be provided in the form of a groove or channel, in which case original wheel assemblies 52*a* and 52*b* ride within the groove or channel for guiding and supporting the door. Track 24 has a base 24*b*, and leading edge wheel 50 rides on base 24*b* for supporting the weight of patio door 20.

Turning now to FIG. 4, wheel 50 is shown in cross section as seen along the lines 4—4 in FIG. 3. A cylinder S1 having a spacer ridge 51*a* receives dual, parallel sets of ball bearings 50*c* and 50*d*, one set on each side of spacer ridge 51*a*. Cylinder 51 is rotatably mounted on axle 46, and spacer ridge 51*a* separates ball bearing set 50*c* from ball bearing set 50*d*. A ball bearing 50*e* is typical of all the ball bearings in sets 50*c* and 50*d*. Sets of bearings 50*c* and 50*d* allow wheel 50 to rotate about axle 46 with relatively little friction. Tire 50*b* is made of a strong, durable synthetic resin and rolls easily on base 24*b* of track 24.

Edge bracket 30 and edge wheel 50 are thus adapted for supporting the weight of patio door 20 and guiding patio door 20 as wheel 50 rolls on base 24*b* of track 24. Original wheel assemblies 52*a* and 52*b* can also guide patio door 20 by engagement of the original wheels on guideway 24*a*. Edge bracket 30 can have a variety of configurations, each of which allows for rotatably securing a wheel to edge 32 near bottom edge 16*a* of bottom panel 16.

With reference to FIG. 1, patio door 20 has a trailing edge 56 that engages channel 26. A side bracket 60 is attached to bottom panel 16 near traiing edge 56. A side wheel 58 is rotatably mounted to side bracket 60 for supporting the weight of patio door 20 and providing a rolling means so that patio door 20 can be opened and closed. Thus, edge wheel 50 and side wheel 58 support the weight of patio door 20 and provide rolling means for sliding or rolling patio door 20 between an opened and a closed position.

In the past, when original wheel assemblies 52*a* and 52*b* wore out, it was very expensive and time consuming to replace the original wheel assemblies. Oftentimes homeowners chose to replace an entire door rather than replace the original wheel assemblies. Edge bracket 30 with wheel 50 and side bracket 60 with wheel 58 allow patio door 20 to be repaired inexpensively and easily, leaving the worn, original wheel assemblies 52*a* and 52*b* in place. Thus, edge bracket 30 with wheel 50 and side bracket 60 with wheel 58 comprise a repair kit for quickly, easily and inexpensively repairing a sliding glass patio door or other types of rolling doors.

Turning to FIGS. 5 and 6, additional detail is provided for side bracket 60. Side bracket 60 includes an inner plate 62 and an outer plate 64. Outer plate 64 has a right angle bend 64*a*. A member 64*b* extends perpendicular from outer plate 64 at bend 64*a*, and a member 64*c* of outer plate 64 extends parallel to inner plate 62. Outer plate 64 has a planner surface 64*d*. Inner plate 62 and outer plate 64 have holes 66*a*, 66*b*, 66*c*, and 66*d* (not shown) through which pass fasteners 68*a*, 68*b*, 68*c*, and 68*d*, respectively. Holes 66*a*, 66*b*, 66*c* and 66*d* are not shown or labeled in the figures, but fasteners 68*a*, 68*b*, 68*c*, and 68*d*, respectively, pass through these holes.

Inner plate 62 has a lower portion 62*a*, which is parallel to member 64*c* of outer plate 64, forming a frame for receiving side wheel 58. Member 64*c* has an axle hole 64*e* and lower portion 62*a* of inner plate 62 has an axle hole 62*b*. An axle 70 is mounted in axle holes 62*b* and 64*e*.

With reference to FIG. 6, wheel 58 has a hub 58*a* and a tire 58*b*. Although not shown, hub 58*a* contains dual, parallel sets of bearings, such as those shown for wheel 50 in FIG. 4. Wheel 58 is also of the type used in in-line roller skates that are known as roller blades. Thus, tire 58*b* is typically made of a solid synthetic plastic, and wheel 58 rolls easily for supporting rolling/sliding patio door 20.

Turning now to FIG. 7, a top view of side bracket 60 and side wheel 58 is illustrated. Side bracket 60 is installed near trailing edge 56. Trailing edge 56 typically has a locking mechanism (not shown) that is used to fasten patio door 20 in locked engagement with channel 26. Channel 26 is fastened to door frame 22, and track 24 fits within channel 26.

Edge bracket 30 and its associated edge wheel 50, side bracket 60 and its associated side wheel 58 and fasteners can be provided in a repair kit. Thus, rather than replacing worn original wheel assemblies 52*a* and 52*b*, one can instead install edge bracket 30 on leading edge 32 and side bracket 60 on side 16*b* of bottom panel 16 or right side panel 14, depending on the configuration of patio door 20. Edge wheel 50 and side wheel 58 support the weight of patio door 20, while original wheel assemblies 52*a* and 52*b* primarily assist in guiding patio door 20 on guideway 24*a* Replacement of original wheel assemblies 52*a* and 52*b* is typically relatively expensive, and brackets 30 and 60 and wheels 50 and 58 provide a much more economical solution.

Edge bracket 30 may have the following dimensions. The total height of edge bracket 30 from the bottom of wheel 50 to the top of edge plate 34 ranges between about 3.5 and about 5.5 inches, preferably between about 4.375 and about 4.875 inches, and more preferably is about 4.625 inches. The distance between the top of edge plate 34 and the center of axle 46 ranges between about 2.0 and about 5.5 inches, preferably between about 3.0 and about 4.5 inches, and more preferably is about 3.75 inches. The height of wheel 50 ranges between about 0.75 and about 3.0 inches, preferably between about 1.25 and about 2.5 inches, and more preferably is about 1.75 inches. The width of wheel 50 from an outside surface of plate 40 to an outside surface of plate 44 ranges between about 0.25 and about 2.0 inches, preferably between about 0.5 and about 1.5 inches, and more preferably is about 0.8125 inches.

The distance between the center of axle 46 and the bottom edge of edge plate 34 ranges between about 0.25 and about 3.0 inches, preferably between about 1.0 and about 2.0 inches, and more preferably is about 1.5 inches. The height of edge plate 34 ranges between about 1.0 and about 3.5 inches, preferably between about 1.5 and about 3.0 inches, and more preferably is about 2.25 inches. The width of edge plate 34 ranges between about 0.5 and about 2.5 inches, preferably between about 1.0 and about 2.0 inches, and more preferably is about 1.5 inches.

The total height of side bracket 60 from the bottom of wheel 58 to the top of inner plate 62 ranges between about 2.5 and about 5.5 inches, preferably between about 3.25 and about 4.5 inches, and more preferably is about 4.125 inches. The height of outer plate 64 above right angle bend 64*a* ranges between about 0.5 and about 3.5 inches, preferably between about 1.25 and about 2.75 inches, and more preferably is about 1.9375 inches. The width of outer plate 64 ranges between about 0.5 and about 2.5 inches, preferably between about 1.0 and about 2.0 inches, and more preferably is about 1.5 inches wide. The length of axle 70 ranges between about 0.25 and about 2.0 inches, preferably between about 0.5 and about 1.5 inches, and more preferably is about 0.8125 inches.

To install edge bracket 30 and side bracket 60, one may lift patio door 20, such as by applying leverage on bottom edge 16*a* to lift patio door 20 or by adjusting the vertical position of original wheel assemblies 52*a* and 52*b*. Edge bracket 30 can be installed by holding edge bracket 30 in proper position while marking locations for drilling holes in leading edge 32. Along with a set of instructions, a template can be provided in the repair kit for indicating the proper location for drilling holes in leading edge 32. Edge bracket 30 can be installed by screwing screws 36*a*, 36*b*, 36*c* and 36*d* into the holes drilled into leading edge 32.

Side bracket 60 can be installed on side 16*b* in similar fashion, and side 16*b* is an exterior side relative to the interior of a home in which door 20 is installed. Patio door 20 may be raised before installing side bracket 60 and lowered after the installation. Patio door 20 can alternatively be taken down altogether for installation of edge bracket 30 and side bracket 60. A template can be provided for locating holes for side bracket 60, or side bracket 60 can be held in place while marking the holes. If patio door 20 is taken down for installation of the brackets, then patio door 20 is reinstalled in door frame 22 after installation of the brackets. Edge wheel 50 is preinstalled on edge bracket 30 at the time of manufacture, as is side wheel 58 on side bracket 60.

Edge bracket 30 and side bracket 60 have been described as a repair kit for use as an alternative to replacing worn original wheel assemblies 52*a* and 52*b*. However, edge bracket 30 and side bracket 60 can be provided as original equipment with wheels 50 and 58, respectively, either in addition to internal wheels or instead of internal wheels. In either case, one wheel and bracket assembly is located in the plane in which patio door 20 moves, and the other bracket and its associated wheel is located in a plane parallel to the plane of movement of patio door 20.

The foregoing disclosure and description of the invention are illustrative and explanatory thereof, and various changes in the details of the illustrated apparatus and construction and method of operation may be made without departing from the spirit of the invention.

What is claimed is:

1. A sliding glass door, comprising:

a door panel adapted for receiving a sheet of glass, the door panel having a leading edge, a trailing edge and a bottom panel, the bottom panel having a bottom edge and a side;

an edge bracket attached to the leading edge proximate to the bottom edge, the edge bracket having a frame and an axle mounted in the frame;

an edge wheel mounted on the axle in the frame in the edge bracket, the edge wheel having a set of bearings;

a side bracket attached to the side of the bottom panel proximate to the trailing edge, the side bracket having a frame and an axle mounted in the frame; and a side wheel mounted on the axle in the frame in the side bracket, the side wheel having a set of bearings.

2. The door of claim 1, further comprising a pair of original wheels mounted in the bottom panel.

3. The door of claim 2, wherein the original wheels are worn and in need of replacement.

4. The door of claim 2 further comprising a track located below the bottom edge of the bottom panel, the track having a base and a guideway, the guideway receiving and guiding the pair of original wheels.

5. The door of claim 1 wherein the set of bearings for each of the edge and side wheels comprises dual, parallel sets of ball bearings.

6. The door of claim 5, wherein the edge and side wheels each include a solid tire comprising a synthetic resin material.

7. The door of claim 5, further including a cylindrical member mounted rotatably about each axle between the axle and the dual, parallel sets of ball bearings.

8. The door of claim 1, wherein the edge bracket includes an edge plate adapted for attachment to the leading edge, and wherein the frame of the edge plate has a U-shape adapted for receiving the first wheel, the U-shape comprising first and second legs spaced apart and extending perpendicularly from the edge plate, the axle extending between the first and second legs.

9. The door of claim 8, wherein the side bracket includes a side plate adapted for attachment to the side of the bottom panel, and wherein the side plate has a planar surface, and the axle in the side bracket has a longitudinal axis that is approximately perpendicular to the planar surface.

* * * * *